US011078689B2

(12) United States Patent
Graute et al.

(10) Patent No.: US 11,078,689 B2
(45) Date of Patent: Aug. 3, 2021

(54) MOTOR VEHICLE LOCK

(71) Applicant: Brose Schliesssysteme GmbH & Co. Kommanditgesellschaft, Wuppertal (DE)

(72) Inventors: Ludger Graute, Essen (DE); David Rosales, Rochester Hills, MI (US)

(73) Assignee: Brose Schliesssysteme GmbH & Co. KG, Wuppertal (DE)

( * ) Notice: Subject to any disclaimer, the term of this patent is extended or adjusted under 35 U.S.C. 154(b) by 650 days.

(21) Appl. No.: 15/809,434

(22) Filed: Nov. 10, 2017

(65) Prior Publication Data

US 2019/0145133 A1 May 16, 2019

(51) Int. Cl.
*E05B 77/06* (2014.01)
*E05B 77/00* (2014.01)
*E05B 77/04* (2014.01)

(52) U.S. Cl.
CPC ..... *E05B 77/06* (2013.01); *E05B 77/04* (2013.01); *Y10S 292/22* (2013.01)

(58) Field of Classification Search
CPC ..... Y10S 292/22; E05B 77/04; E05B 77/06
See application file for complete search history.

(56) References Cited

U.S. PATENT DOCUMENTS 4,536,021 A * 8/1985 Mochida ..... E05B 77/12 292/201
4,806,712 A 2/1989 Hoffman et al.
5,639,130 A 6/1997 Rogers, Jr. et al.
5,865,481 A * 2/1999 Buschmann ..... E05B 77/06 292/216
5,938,252 A 8/1999 Uemura et al.
(Continued)

FOREIGN PATENT DOCUMENTS

CH 29622837.0 7/1997
DE 19511651 A1 * 10/1995 ..... E05B 77/06
(Continued)

OTHER PUBLICATIONS

Non-Final Office Action for U.S. Appl. No. 15/828,879 dated Jun. 24, 2019 (15 pages).
(Continued)

*Primary Examiner* — Carlos Lugo
(74) *Attorney, Agent, or Firm* — Pauly, DeVries Smith & Deffner LLC

(57) ABSTRACT

The disclosure relates to a motor vehicle lock, wherein the motor vehicle lock comprises an actuating lever which is pivotable about an actuating lever axis. The motor vehicle lock has an adjustable crash element which is adjustable into a released position in which the locking pawl is disengageable by an actuation of the actuating lever and into a crash position in which the crash element blocks the actuating lever in a blocked position or decouples the actuating lever from the locking pawl. It is proposed that the crash element is coupled to the actuating lever such that, with an actuation of the actuating lever and depending on the actuating lever speed, the crash element reaches the released position from a central position either in a first adjusting direction or the crash element reaches the crash position in a second adjusting direction and is latched in the crash position.

18 Claims, 5 Drawing Sheets

(56) References Cited

U.S. PATENT DOCUMENTS

| | | | | |
|---|---|---|---|---|
| 6,053,542 | A | 4/2000 | Ostrowski et al. | |
| 6,123,372 | A | 9/2000 | Rogers, Jr. et al. | |
| 6,125,583 | A | 10/2000 | Murray et al. | |
| 6,256,932 | B1 | 7/2001 | Jyawook et al. | |
| 6,382,687 | B1 | 5/2002 | Gruhn | |
| 6,435,600 | B1 | 8/2002 | Long et al. | |
| 6,505,867 | B1 | 1/2003 | Szablewski et al. | |
| 6,520,548 | B1 | 2/2003 | Fisher et al. | |
| 6,679,531 | B2 | 1/2004 | Rogers, Jr. et al. | |
| 6,719,356 | B2 | 4/2004 | Cleland et al. | |
| 7,059,640 | B2 | 6/2006 | Tensing et al. | |
| 7,607,702 | B2 * | 10/2009 | Pereverzev | E05B 77/06 292/201 |
| 8,056,944 | B2 * | 11/2011 | Jankowski | E05B 77/06 292/201 |
| 8,474,887 | B2 | 7/2013 | Suzuki et al. | |
| 8,485,570 | B2 * | 7/2013 | Konchan | E05B 77/06 292/194 |
| 9,103,154 | B2 | 8/2015 | Sitzler et al. | |
| 9,255,436 | B2 | 2/2016 | Schönherr et al. | |
| 9,677,318 | B2 | 6/2017 | Rosales et al. | |
| 10,005,498 | B2 | 6/2018 | Rosales et al. | |
| 10,801,236 | B2 | 10/2020 | Rosales | |
| 2002/0040551 | A1 | 4/2002 | Zhou | |
| 2004/0124662 | A1 | 7/2004 | Cleland et al. | |
| 2004/0212210 | A1 | 10/2004 | Roach | |
| 2005/0039404 | A1 | 2/2005 | Mrkovic et al. | |
| 2005/0155289 | A1 | 7/2005 | Oberheide | |
| 2006/0181108 | A1 | 8/2006 | Cleland et al. | |
| 2007/0079556 | A1 | 4/2007 | Oberheide | |
| 2008/0052996 | A1 | 3/2008 | Sugiura | |
| 2008/0105011 | A1 | 5/2008 | Machida et al. | |
| 2009/0107048 | A1 | 4/2009 | Nagai et al. | |
| 2009/0217596 | A1 | 9/2009 | Neundorf et al. | |
| 2009/0267786 | A1 | 10/2009 | Sakamaki et al. | |
| 2011/0057469 | A1 | 3/2011 | Zielinsky | |
| 2012/0285087 | A1 | 11/2012 | Eggeling et al. | |
| 2012/0299313 | A1 | 11/2012 | Organek et al. | |
| 2014/0284939 | A1 | 9/2014 | Wittelsbuerger et al. | |
| 2015/0283886 | A1 | 10/2015 | Nania | |
| 2016/0010379 | A1 | 1/2016 | Sauerwein et al. | |
| 2016/0052375 | A1 | 2/2016 | Scheuring et al. | |
| 2016/0052376 | A1 | 2/2016 | Rosales et al. | |
| 2016/0169886 | A1 | 6/2016 | Chou | |
| 2016/0245010 | A1 | 8/2016 | Makino et al. | |
| 2016/0312500 | A1 | 10/2016 | Hiramoto et al. | |
| 2017/0089112 | A1 | 3/2017 | Rosales et al. | |
| 2017/0247927 | A1 | 8/2017 | Elie et al. | |
| 2019/0169886 | A1 | 6/2019 | Rosales | |
| 2019/0169887 | A1 | 6/2019 | Rosales | |

FOREIGN PATENT DOCUMENTS

| | | | | |
|---|---|---|---|---|
| DE | 19738492 | A1 * | 3/1998 | E05B 77/06 |
| DE | 202012004789 | | 10/2013 | |
| EP | 1371799 | A2 * | 12/2003 | E05B 77/06 |
| EP | 1700989 | | 9/2006 | |
| EP | 2339098 | | 6/2011 | |
| EP | 3121354 | | 1/2017 | |
| WO | 2012059161 | | 5/2012 | |

OTHER PUBLICATIONS

Notice of Allowance for U.S. Appl. No. 14/832,236 dated Feb. 13, 2017 (6 pages).

Non-Final Office Action for U.S. Appl. No. 16/057,329 dated Dec. 23, 2019 (23 pages).

File History for U.S. Appl. No. 14/832,236 downloaded Feb. 6, 2018 (167 pages).

File History for U.S. Appl. No. 15/075,665 downloaded Feb. 6, 2018 (127 pages).

Notice of Allowance for U.S. Appl. No. 16/057,329 dated Jun. 11, 2020 (8 pages).

Response to Non-Final Rejection dated Dec. 23, 2019 for U.S. Appl. No. 16/057,329, submitted via EFS-Web on May 26, 2020, 13 pages.

* cited by examiner

MOTOR VEHICLE LOCK

FIELD OF THE TECHNOLOGY

The disclosure relates to a motor vehicle lock. In the present case, all types of locks for a door, hood or tailgate are encompassed by the term "motor vehicle lock".

BACKGROUND

In the context of ever-increasing safety requirements in motor vehicles, the crash safety of the motor vehicle lock in question is of particular importance. With regard to the motor vehicle lock, this means that crash accelerations should not lead to an inadvertent opening of the motor vehicle lock. Such an inadvertent opening of the motor vehicle lock may be caused, for example, by the crash accelerations causing an automatic disengagement of a door handle.

The known motor vehicle lock (EP 2 339 098 A2), on which the disclosure is based, shows in one variant a mechanism for avoiding the inadvertent opening of the motor vehicle lock as a result of a crash. In this case, a crash element is provided, said crash element being latched in a crash position when an actuating lever is actuated at excessive actuating speed, as is to be anticipated in the event of a crash. In this crash position, the crash element blocks the actuating lever coupled to the door handle so that an inadvertent opening of the motor vehicle lock as a result of a crash is eliminated.

The latching of the crash element in the crash position is advantageous insofar that crash accelerations often occur as a result of a plurality of individual accelerations which are different in terms of direction and intensity. Thus it may arise that two crash accelerations directly follow one another. By means of the above latching, in the known motor vehicle lock it is avoided that the subsequent crash accelerations trigger an inadvertent opening of the motor vehicle lock.

The structural implementation of the above-described crash mechanism provides a challenge to the person skilled in the art with regard to costs, compactness and operating safety, in particular when it is considered that in the crash state the latching has to be released again after the crash in the most uncomplicated manner possible.

SUMMARY

The problem underlying the disclosure is to simplify the known motor vehicle lock with regard to the crash mechanism, with a high level of operating reliability, a high level of compactness and with low costs.

The above problem is solved in a motor vehicle lock as described herein.

An aspect of the disclosure is the principal consideration that in the case of normal actuation the crash element is adjusted from a central position in a first adjusting direction and in the case of a crash actuation said crash element is adjusted in a second adjusting direction. This leads to a structural separation of the movement range of the crash element assigned to normal actuation from the movement range of the crash element assigned to crash actuation, which permits an implementation of the measures required for the crash actuation substantially independently of the measures required for the normal actuation. The adjustability of the crash element in the two adjusting directions may be implemented in a manner which is cost-effective and which at the same time is operationally reliable by using a simple mechanism, in particular a cam-cam follower mechanism to be described below.

In the present case a crash actuation is such an actuation of the actuating lever which is caused by crash accelerations occurring in the event of a crash. Such crash accelerations are often more than 20 g. A normal actuation, however, is such an actuation of the actuating lever which is caused by a manual actuating movement by an operator.

In detail, it is proposed that the crash element is coupled to the actuating lever such that, with an actuation of the actuating lever depending on the actuating lever speed, the crash element reaches the released position from a central position either in a first adjusting direction or said crash element reaches the crash position in a second adjusting direction and is latched in the crash position. In the crash position, depending on the application, it is provided that the crash element in the crash position blocks the actuating lever either in a blocked position or decouples said actuating lever from the locking pawl.

In some embodiments, with an actuation of the actuating lever at an actuating lever speed below a limit speed, the crash element reaches the released position and, above the limit speed, said crash element reaches the crash position.

All of the information which pertains to the limit speed in the present case is to be understood such that at least any actuating lever speed below the limit speed leads to an adjustment of the crash element into the released position and that at least any actuating lever speed above the limit speed leads to an adjustment of the crash element into the crash position. In this regard, the limit speed does not form a sharply defined boundary between a rapid actuation and a slow actuation of the actuating lever. Instead, this information is intended to clarify that a relatively slow actuation, which corresponds to normal actuation, leads to an adjustment of the crash element into the released position and that a relatively rapid actuation, which corresponds to the crash actuation, leads to an adjustment of the crash element into the crash position.

Various embodiments also refer to a particularly user-friendly disengagement of the latching of the crash element. In this case, it is proposed that the return of the actuating lever into the initial position already effects the disengagement of the latching. The disengagement of the latching could hardly be implemented in a more intuitive manner.

Further embodiments refer to variants for the movement control of the crash element by means of a control mechanism which provides the coupling between the actuating lever and the crash element. In further embodiments, the control mechanism is a cam-cam follower mechanism with a control cam and a cam follower running in the control cam, wherein the control cam and the cam follower in each case are assigned to one of the components, namely the actuating lever and the crash element. Such an arrangement is able to be implemented in a mechanically simple manner and is compact since the control cam may be designed as a simple recess in one of the two components, whilst the cam follower may be implemented simply as a curved portion, a riveted-on pin or the like. In principle, the control cam may be designed to be closed or open. It may also be formed from a plurality of cam portions which are optionally not connected together.

Various embodiments relate to details of the control cam. In some embodiments, in the event of a crash the adjustment of the crash element from the central position into the crash position is caused by a forced guidance between the control cam and the cam follower, in this case between the crash-cam portion and the cam follower. This is advantageous since during this adjustment of the crash element the crash element also has to be latched in the crash position which in principle requires a certain amount of force expenditure, which is able to be easily transmitted to the crash element via this forced guidance.

An embodiment provides a motor vehicle lock having the locking elements, namely a latch and a locking pawl, wherein the motor vehicle lock comprises an actuating lever which is pivotable about an actuating lever axis, by the actuation thereof the locking pawl being disengageable from an initial position into an actuating position, wherein the motor vehicle lock comprises an adjustable crash element which is adjustable into a released position in which the locking pawl is disengageable by an actuation of the actuating lever and into a crash position in which the crash element blocks the actuating lever in a blocked position or decouples the actuating lever from the locking pawl, wherein the crash element is coupled to the actuating lever such that, with an actuation of the actuating lever and depending on the actuating lever speed, the crash element reaches the released position from a central position either in a first adjusting direction or said crash element reaches the crash position in a second adjusting direction and is latched in the crash position.

In some embodiments, the first adjusting direction of the crash element and the second adjusting direction of the crash element are opposed to one another.

In some embodiments, the crash element is pivotable about a crash element axis and in that the crash element reaches the central position, the released position and the crash position by a pivoting of the crash element about the crash element axis.

In some embodiments, with an actuation of the actuating lever at an actuating lever speed which is below a limit speed, the crash element reaches the released position from the central position and in that, with an actuation of the actuating lever at an actuating lever speed which is above the limit speed, the crash element reaches the crash position from the central position and is latched in the crash position, and/or in that when the crash element is latched in the crash position, a return of the actuating lever into the initial position effects the release of the latching and the adjustment of the crash element into the central position.

In some embodiments, a crash element spring is provided, said crash element spring pretensioning the crash element, in particular, into the released position, such as in that the crash element spring is designed as a wire spring, in particular as a leg spring.

In some embodiments, a latching arrangement is provided with a latching spring which latches the crash element during its adjustment into the crash position, such as in that with an adjustment of the crash element from the crash position into the central position, the latching of the crash element is released, in particular by an overlatching of the latching spring.

In some embodiments, the latching spring is provided by the crash element spring and/or is designed integrally with the crash element spring.

In some embodiments, the coupling between the actuating lever and the crash element comprises a control mechanism for the movement control of the crash element, said control mechanism guiding the crash element from the central position, either into the released position or into the crash position depending on the actuating lever speed.

In some embodiments, when the crash element is latched in the crash position and when the actuating lever returns into the initial position, the control mechanism effects the release of the latching and the adjustment of the crash element into the central position.

In some embodiments, when the crash element is latched in the crash state and only when the actuating lever is returned by at least 80 percent relative to the movement range between the initial position and the actuating position, such as only when the actuating lever is fully returned into the initial position, the control mechanism causes the release of the latching and the adjustment of the crash element into the central position.

In some embodiments, the control mechanism comprises a control cam and a cam follower operatively connected to the control cam, and which in each case are assigned to one of the components, namely the actuating lever and crash element.

In some embodiments, the control cam comprises a start-cam portion, the cam follower being supported thereon by the pretensioning of the crash element spring, when the actuating lever is in the initial position, and said start-cam portion determining the central position of the crash element.

In some embodiments, a release-cam portion adjoins the start-cam portion, the cam follower sliding along said release-cam portion when the actuating lever is actuated and depending on the actuating speed, in particular at an actuating lever speed below the limit speed, and whereby the crash element, driven by the pretensioning of the crash element spring, is guided from the central position into the released position.

In some embodiments, when the crash element is in the released position and when the actuating lever is returned from the actuating position into the initial position, the cam follower comes into engagement with the release-cam portion and slides along said portion, whereby the crash element is guided counter to the pretensioning of the crash element spring from the released position into the central position.

In some embodiments, the control cam comprises a crash-cam portion and in that, with an actuation of the actuating lever and depending on the actuating lever speed, in particular at an actuating lever speed above the limit speed, by the mass inertia of the crash element the cam follower comes into engagement with the crash-cam portion and slides along said crash-cam portion, whereby the crash element is guided from the central position into the crash position, in particular counter to the pretensioning of the crash element spring, and is latched there, such as in that the crash element in the crash position blocks a further actuation of the actuating element in the blocked position via the engagement between the cam follower and the crash-cam portion.

In some embodiments, the control cam comprises a reset-cam portion and in that when the crash element is latched in the crash position and when the actuating lever, in particular, has returned from the blocked position into the initial position, the cam follower comes into engagement with the reset-cam portion and slides along said portion, whereby the crash element is guided from the crash position into the central position, releasing the latching.

BRIEF DESCRIPTION OF THE DRAWINGS

The disclosure is described in more detail hereinafter with reference to a drawings showing only one exemplary embodiment. In the drawings.

DETAILED DESCRIPTION

Figure 1:
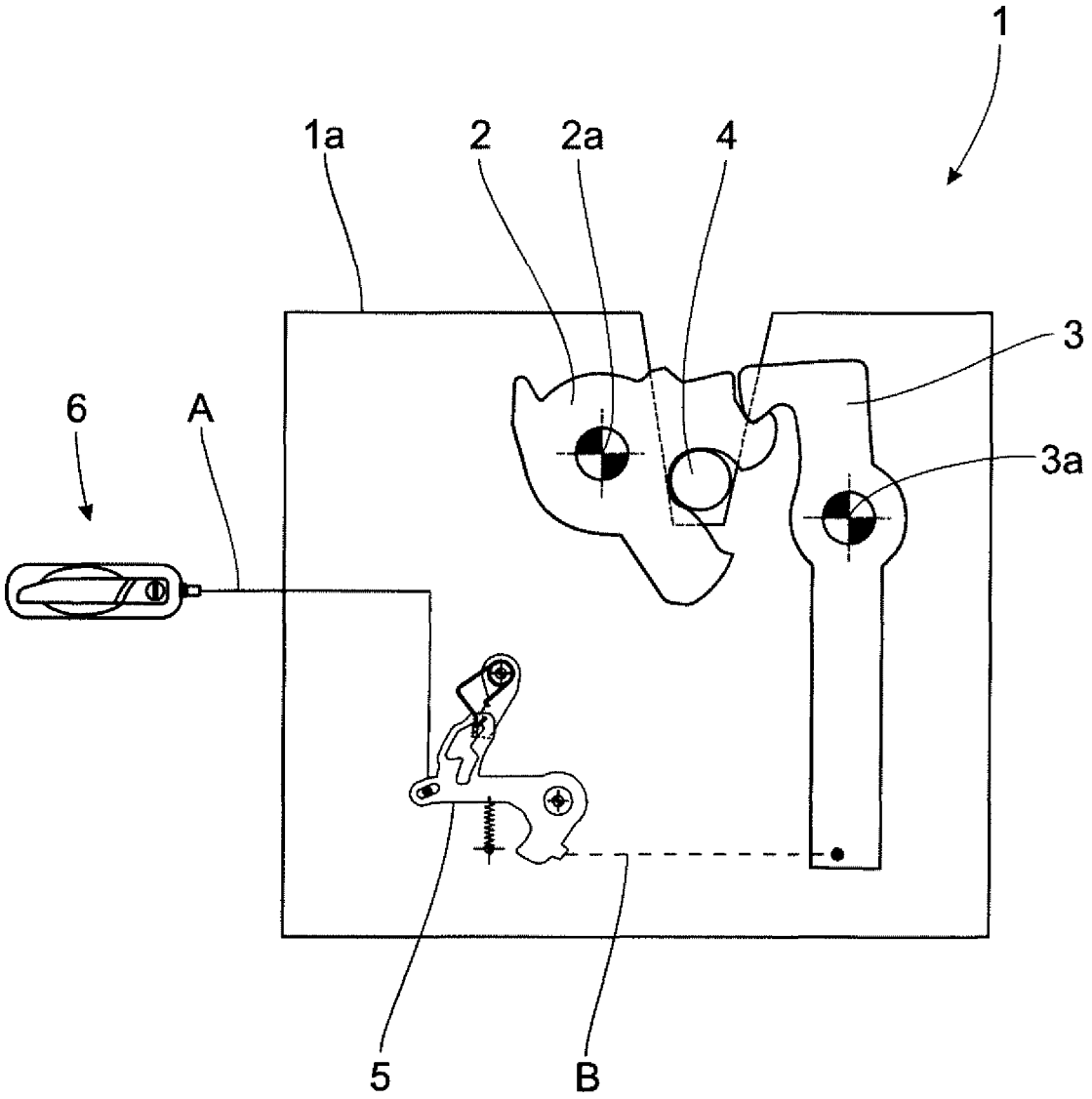
FIG. 1 shows the proposed motor vehicle lock in a very schematic view.

Firstly it should be mentioned that only the components of the proposed motor vehicle lock 1 which are required for the explanation of the teaching are shown in the drawing. For example, the view of a lock mechanism which provides the setting of different locked states, such as "locked" and "unlocked", has been dispensed with. Also, in the present case a view of an internal door handle has been dispensed with. All of the following embodiments apply to motor vehicle locks correspondingly having such components, not shown here.

FIG. 1 shows that the motor vehicle lock 1 has a lock housing 1*a* and locking elements therein, namely a latch 2 and locking pawl 3, which are operatively connected together in the conventional manner. The latch 2 is pivotable into the main locked position, shown in FIG. 1, in which it is held by the locking pawl 3. In this case, the latch 2 is in retained engagement with a locking part 4 which is designed in this case as a locking bolt. The locking pawl 3 may be pivoted about a locking pawl axis 3*a*, clockwise in FIG. 1, so that the latch 2 is released and may pivot about a latch axis 2*a* in FIG. 1 counterclockwise in the opening direction. Then the locking part 4 is released and the motor vehicle door or the like, assigned to the motor vehicle lock 1, may be opened.

Figure 2:
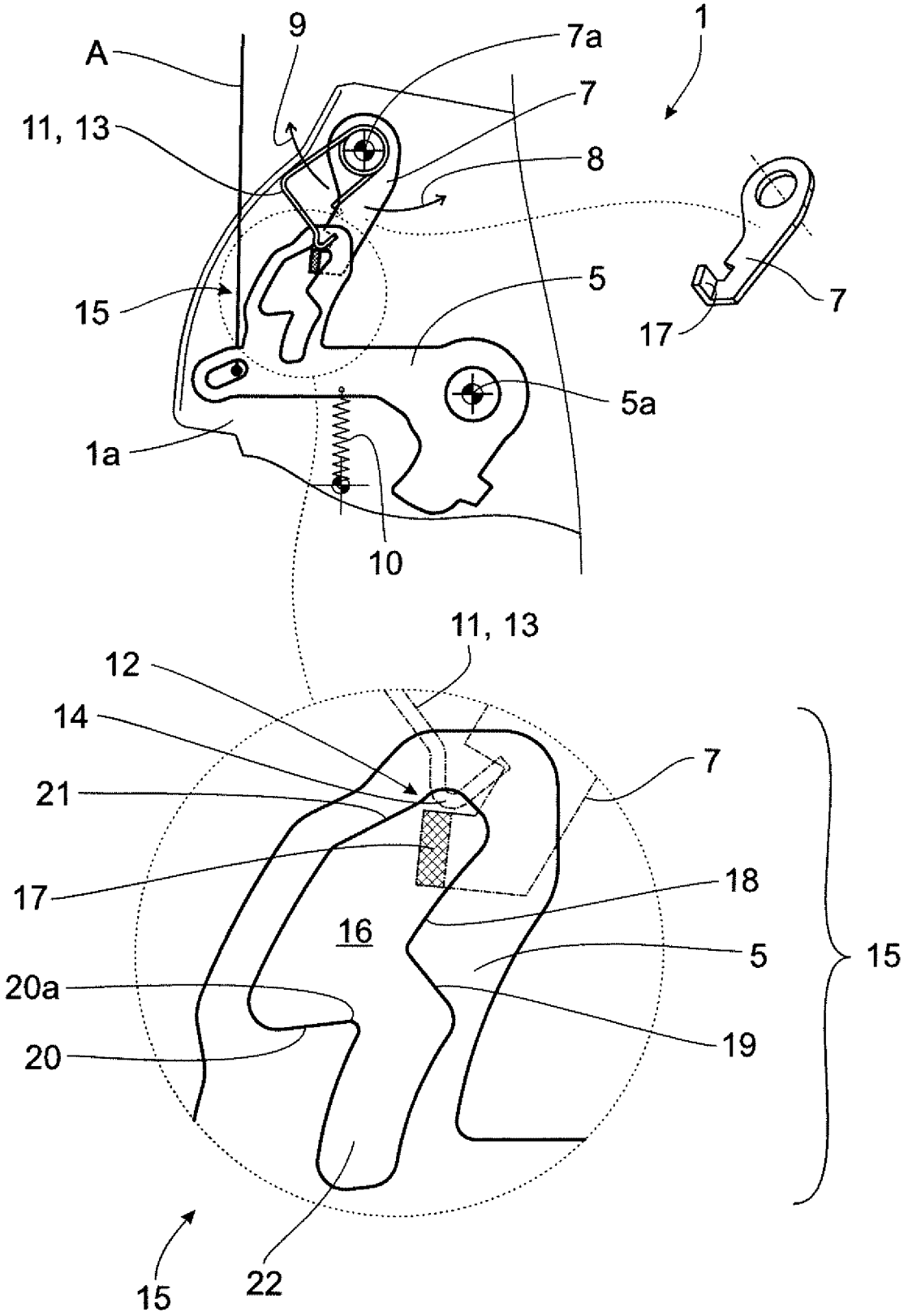
FIG. 2 shows the arrangement of the actuating lever and the crash element of the motor vehicle lock according to FIG. 1 when the actuating lever is not actuated.
Figure 3:
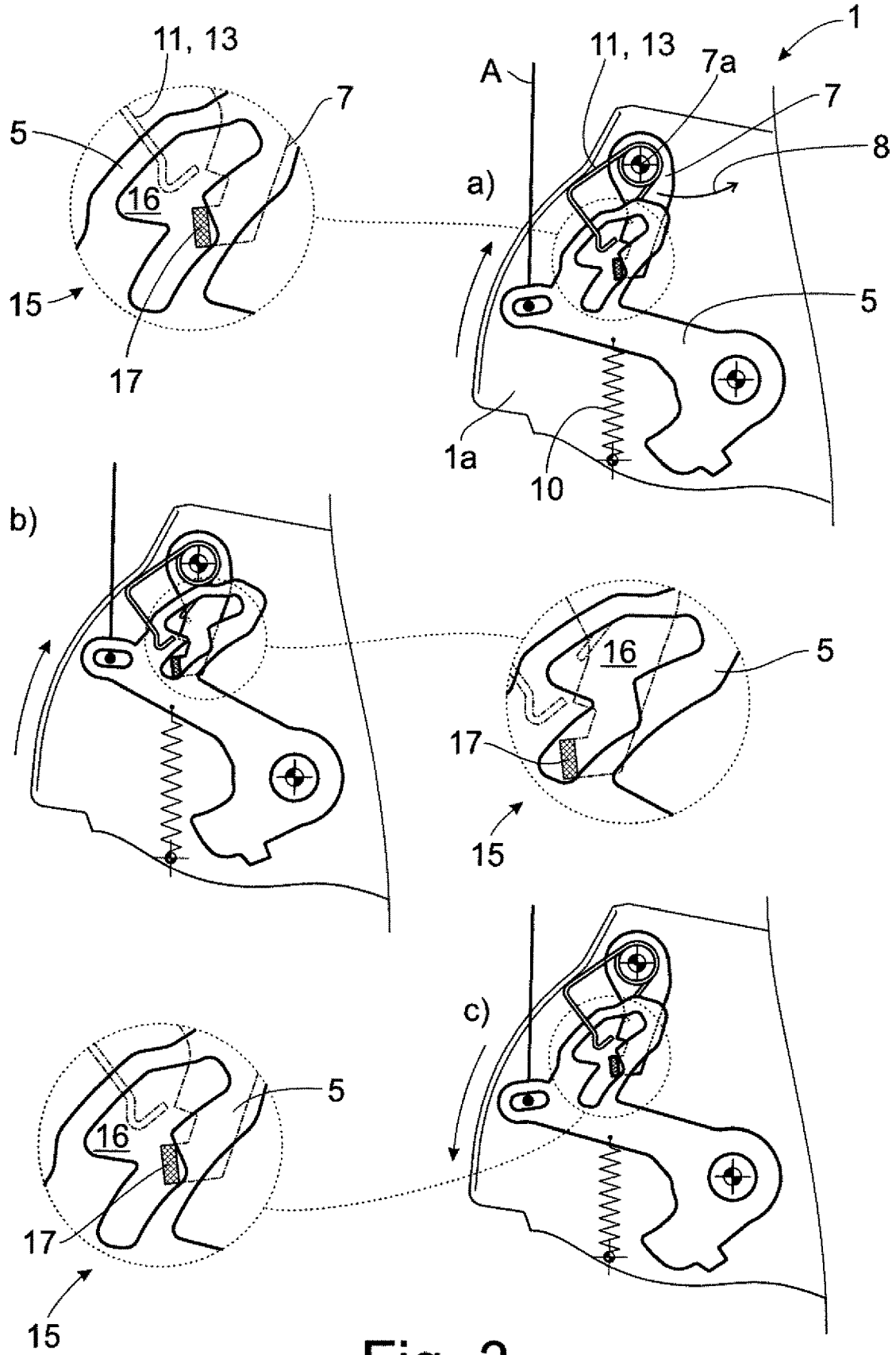
FIG. 3 shows the arrangement according to FIG. 2 in the normal case, a) during the actuation of the actuating lever between the initial position and the actuating position, b) during the actuation of the actuating lever in the actuating position, and c) during the return of the actuating lever between the actuating position and the initial position.
Figure 4:
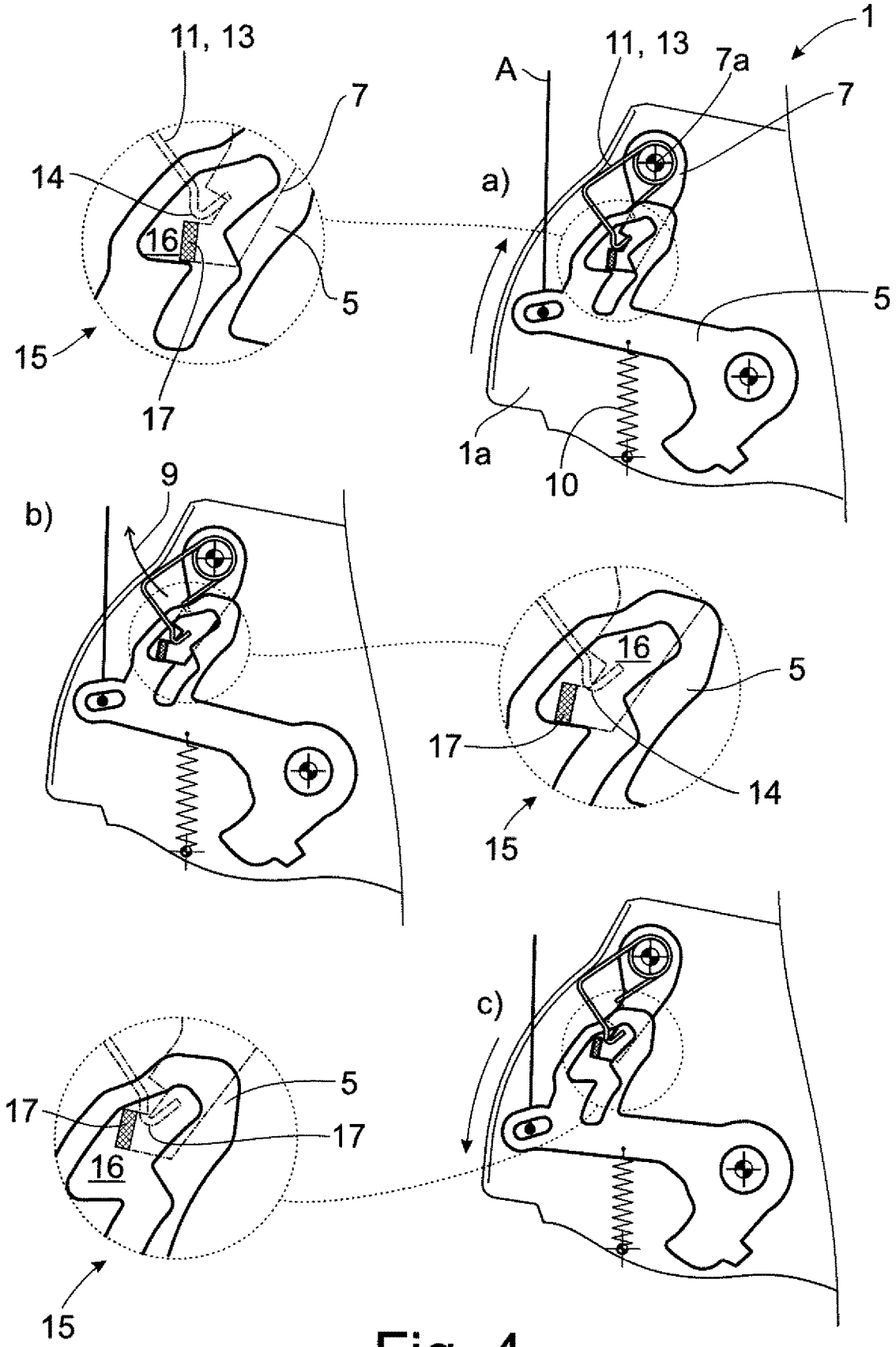
FIG. 4 shows the arrangement according to FIG. 2 in the case of a crash, a) during the actuation of the actuating lever between the initial position and the blocked position, b) during the actuation of the actuating lever in the blocked position, and c) during the return of the actuating lever between the blocked position and the initial position

The proposed motor vehicle lock 1 comprises at least one actuating lever 5 which is pivotable about an actuating lever axis 5*a*, by the actuation thereof said locking pawl 3 being disengageable from an initial position into an actuating position. The initial position is shown in FIG. 2. The actuation of the actuating lever 5 in the normal case results from the sequence of FIGS. 2, 3*a* and 3*b*. The ability to disengage the locking pawl 3 depends, according to the embodiment of the motor vehicle lock 1, not only on the actuation of the actuating lever 5 but also on the locked state of a lock mechanism which is possibly provided but not shown here. This, however, is not significant for the proposed solution.

The actuating lever 5 is coupled in this case to a door handle 6, in particular an external door handle. In principle, however, the door handle 6 may also be an internal door handle or any other door handle. In FIGS. 2 to 5 the drive train to the door handle 6 is indicated by the reference numeral A, whilst the drive train to the locking pawl 3 is indicated by the reference numeral B. The drive train B is shown in dashed lines, due to the possibly provided lock mechanism.

Moreover, the motor vehicle lock 1 is provided with a crash element 7 which in a manner to be described below is adjustable into a released position, which is shown in FIG. 3*b* and in which the locking pawl 3 is disengageable by an actuation of the actuating lever 5, and into a crash position shown in FIG. 4*b* in which the crash element 7 blocks the actuating lever 5 in a blocked position. Alternatively, it may also be provided that when the crash element 7 is in the crash position the actuating lever 5 is decoupled from the locking pawl 3, as will also be described below.

In some embodiments, the crash element 7 is coupled to the actuating lever 5 such that, with an actuation of the actuating lever 5 and depending on the actuating lever speed, the crash element 7 reaches the released position (FIG. 3*b*)) from a central position (FIG. 2) either in a first adjusting direction 8 or said crash element reaches the crash position in a second adjusting direction 9 and is latched in the crash position (FIG. 4*b*)). In this case, the speed-dependent adjustment of the crash element 7 is caused by the inertial forces which act on the crash element 7. With a relatively slow actuation of the actuating lever 5 the crash element 7 follows its pretensioning, also to be explained below. With a relatively rapid actuation, the inertial force acting on the crash element 7 ensures that the crash element 7 is not able to follow its pretensioning rapidly enough and is guided by the actuating lever 5 into the crash position.

The term "latched" here means that the crash element 7 initially remains in the crash state, even if the actuation of the actuating lever 5 ceases in the case of excessive actuating speed. Only when the latching is released is the crash element 7 able to fall again into the central position. A comparison of FIG. 2 with FIG. 3*b*) and a comparison of FIG. 2 with FIG. 4*b*) shows that the first adjusting direction 8 of the crash element 7 and the second adjusting direction 9 of the crash element 7 are opposed to one another.

In this case, the crash element 7 is pivotable about a crash element axis 7*a*, wherein the crash element 7 reaches the central position, the released position and the crash position by a pivoting of the crash element 7 about the crash element axis 7*a*. The pivotable embodiment of the crash element 7 results in an arrangement which is simple to implement and which is mechanically robust.

Generally in the exemplary embodiments shown, with an actuation of the actuating lever 5 at an actuating lever speed which is below a limit speed, the crash element 7 reaches the released position (FIG. 3*b*)) from the central position (FIG. 2) and with an actuation of the actuating lever 5 at an actuating lever speed which is above the limit speed, the crash element 7 reaches the crash position (FIG. 4*b*)) from the central position (FIG. 2) and is latched in the crash position.

Interesting in the exemplary embodiments shown, is the fact that when the crash element 7 is latched in the crash position, a return of the actuating lever 5 into the initial position effects the release of the latching and the adjustment of the crash element 7 into the normal position. The return of the actuating lever 5 is shown in the drawing by the transition from FIG. 3*b*) to FIG. 3*c*) and to FIG. 2. This automatic release of the latching is, in particular, advantageous when the operator is not aware of the function of the crash element 7 so that the functionality is also comprehensively provided even in the event of a crash.

In addition, after the return of the actuating lever 5 the crash element 7 is immediately ready to be transferred again into the crash position with the occurrence of a further crash acceleration. In this regard, a particularly high level of crash safety results in turn.

The actuating lever axis 5*a* can be fixedly arranged in the motor vehicle lock 1, i.e. fixed to the housing. In this case, the crash element axis 7*a* is also fixedly arranged in the motor vehicle lock 1, i.e. fixed to the housing. In this case, the crash element axis 7*a* can also be arranged remotely from the actuating lever axis 5*a*.

In an embodiment, the crash element 7 is mounted on the actuating lever 5. Other arrangements of the actuating lever 5 and crash element 7, which correspondingly require other coupling mechanisms between these two components, are conceivable.

From the view according to FIG. 2 it may be derived that a crash element spring 11 is provided, said crash element spring in this case pretensioning the crash element 7 into the released position, in FIG. 2 counterclockwise. From this view it may also be derived that the crash element spring 11 is designed as a wire spring, in this case as a leg spring. Other ways of implementing the crash element spring 11 are conceivable. The crash element spring 11 for producing the pretensioning of the crash element 7 into its released position, as may be derived most clearly from the view according to FIG. 2, is supported on the lock housing 1*a*, on the one hand, and on the crash element 7, on the other hand.

The actuating lever 5, however, is pretensioned by an actuating lever spring 10 in the direction of the initial position, counterclockwise in FIG. 2.

A particularly advantageous variant for implementing the latching of the crash element 7 in its crash position may also be derived from the view according to FIG. 2. Here a latching arrangement 12 is provided with a latching spring 13 which latches the crash element 7 during its adjustment into the crash position. The process of the latching of the crash element 7 results from the transition from FIG. 4*a*) to FIG. 4*b*). In detail the latching spring 13 forms a latching lug 14, during the transition from FIG. 4*a*) to FIG. 4*b*) the crash element 7 being latched over said latching lug, such that the crash element 7 is secured in a latched manner in the crash position shown in FIG. 4*b*). With an adjustment of the crash element 7 from the crash position into the central position, which corresponds to a transition from FIG. 4*c*) to FIG. 2, the latching of the crash element 7 is released, in this case by an overlatching of the latching spring 13 on this occasion in the opposing direction. Other types of latching are conceivable.

A particularly compact embodiment results from the latching spring 13 being provided by the crash element spring 11. The crash element spring 11 in this regard has a dual function. In this case, the latching spring 13 is designed integrally with the crash element spring 11.

In the exemplary embodiment shown, the latching spring 13 is bent back from a leg of the crash element spring 11 designed as a leg spring. In this case, the latching spring 13 and the crash element spring 11 are configured integrally as discussed above.

Alternatively, the latching spring 13 may be provided by a leg of the crash element spring 11 itself, designed as a leg spring. Then the latching lug 14 of the latching spring 13 can be configured in an end region of the relevant leg of the crash element spring 11.

Provided the crash element 7 is designed as a lever which is pivotable about a crash element axis 7*a*, a cam follower 17 being arranged on the lever arm thereof, to be explained further below, it may be advantageous that the winding axis of the crash element spring 11 which is designed as a leg spring is aligned with the crash element axis 7*a* and that a leg is in non-positive engagement with the cam follower (not shown). In some embodiments, this leg at the end side has the latching lug 14 of the latching spring 13, which can be further supported on the cam follower 17. As a result, the leg spring is stabilized by the crash element 7 which permits a design which is particularly insensitive to tolerances. As in all of the described variants the crash element spring 11 is continuously in non-positive engagement with the crash element 7, the provision of the latching spring 13 by the crash element spring 11 is also particularly advantageous in this regard relative to potential production tolerances.

All of the above variants in which the crash element spring 11 is designed integrally with the latching spring 13 result in lower material and mounting costs and, due to a reduction in mechanical interfaces, are in turn particularly insensitive to tolerances.

The movement of the proposed crash element 7, as discussed above, is caused by the coupling between the actuating lever 5 and the crash element 7. In the exemplary embodiments shown, this coupling comprises a control mechanism 15 for the movement control of the crash element 7, said control mechanism guiding the crash element 7, as also indicated above, when the actuating lever 5 is actuated at an actuating lever speed below the limit speed, into the released position and guiding the crash element 7, at an actuating lever speed above the limit speed, into the crash position.

Additionally, the function of releasing the latching of the crash element 7 is assigned to the control mechanism 15. In detail, when the crash element 7 is latched in the crash position and when the actuating lever 5 returns into the initial position, the control mechanism 15 effects the release of the latching and the adjustment of the crash element 7 into the central position.

In principle, it may be provided that, when the crash element 7 is latched in the crash position and only when the actuating lever 5 is returned by at least 80 percent relative to the movement range between the initial position and the actuating position, in this case only when the actuating lever 5 is fully returned into the initial position, this causes the release of the latching and the adjustment of the crash element 7 into the central position. This means that after an actuation of the actuating lever 5 due to a crash, a return of the actuating lever 5 is provided over a specific path without the latching being released. If during this return, therefore, it leads to a further actuation due to a crash, the crash element 7 is still in the crash state, so that the actuating lever 5 is still blocked (FIG. 4*c*)) or runs freely (FIG. 5)).

Different variants are advantageous for implementing the control mechanism 15, depending on the application. In the exemplary embodiments shown, the control mechanism 15 comprises a control cam 16 and a cam follower 17 operatively connected to the control cam 16, and which in each case are assigned to one of the components, namely the actuating lever 5 and crash element 7. In the exemplary embodiments shown, the control cam 16 is assigned to the actuating lever 5 and the cam follower 17 is assigned to the crash element 7.

From the view according to FIG. 2 it may be derived that the control cam 16 comprises a start-cam portion 18, the cam follower 17 being supported thereon by the pretensioning of the crash element spring 11, when the actuating lever 5 is in the initial position, and said start-cam portion determining the central position of the crash element 7.

In this case, a release-cam portion 19 adjoins the start-cam portion 18, the cam follower 17 sliding along said release-cam portion when the actuating lever 5 is actuated at an actuating lever speed below the limit speed, whereby the crash element 7, driven by the pretensioning of the crash element spring 11, is guided from the central position into the released position. In this case, the cam follower 17 enters a cam channel 22. This appears from the transition from FIG. 2 to FIG. 3*a*) and to FIG. 3*b*).

From the situation shown in FIG. 3*b*), i.e. when the crash element 7 is in the released position, a return of the actuating lever 5 from the actuating position into the initial position leads to the cam follower 17 coming into engagement with the release-cam portion 19, and sliding along said portion, whereby the crash element 7 is guided counter to the pretensioning of the crash element spring 11 from the released position into the central position. This appears from the transition from FIG. 3*b*) to FIG. 3*c*) and to FIG. 2.

For the crash actuation, the control cam 16 is provided with a crash-cam portion 20. With an actuation of the actuating lever 5 at an actuating lever speed above the limit speed, by the mass inertia of the crash element 7 the cam follower 17 comes into engagement with the crash-cam portion 20 and slides along said crash-cam portion. This appears in the transition from FIG. 2 to FIG. 4*a*) and to FIG. 4*b*. The transition from FIG. 4*a*) to FIG. 4*b*) shows that by the cam follower 17 sliding along the crash-cam portion 20, the crash element 7 is guided from the central position into the crash position, in this case counter to the pretensioning of the crash element spring 11, and is latched there by the latching arrangement 12. From the view according to FIG. 4*b*) it may be derived that the crash element 7 in the crash position blocks a further actuation of the actuating element 5 in the blocked position via the engagement between the cam follower 17 and the crash-cam portion 18.

In the event of the crash actuation, therefore, the cam follower 17 initially slides along the start-cam portion 18. The cam follower is pretensioned by the crash element spring 11 on the start-cam portion 18 and with a further actuation of the actuating lever 5 would, in principle, be driven by the pretensioning of the crash element spring 11 sliding along the release-cam portion 19, so that the crash element 7 would reach the released position. However, in the event of a crash the actuation of the actuating lever 5 is carried out at such a high actuating lever speed that the crash-cam portion 20 with its capture portion 20*a* comes into engagement with the cam follower 17 before the crash element 7 is able to pivot substantially in the direction of its released position. By the continued actuation of the actuating lever 5, the crash-cam portion 20 guides the cam follower 17 and thus the crash element 7 in FIG. 4*b*) to the left so that the crash element 7 reaches the crash position and is correspondingly latched there by the latching arrangement 12, in particular by the overlatching of the latching spring 13.

Finally, the control cam 16 comprises a reset-cam portion 21, wherein, when the crash element 7 is latched in the crash position and when the actuating lever 5 has returned from the blocked position into the initial position, the cam follower 17 comes into engagement with the reset-cam portion 21 and slides along said portion, whereby the crash element 7 is guided from the crash position into the central position, releasing the latching. This appears from the transition from FIG. 4*b*) to FIG. 4*c*) and to FIG. 2.

Figure 5:
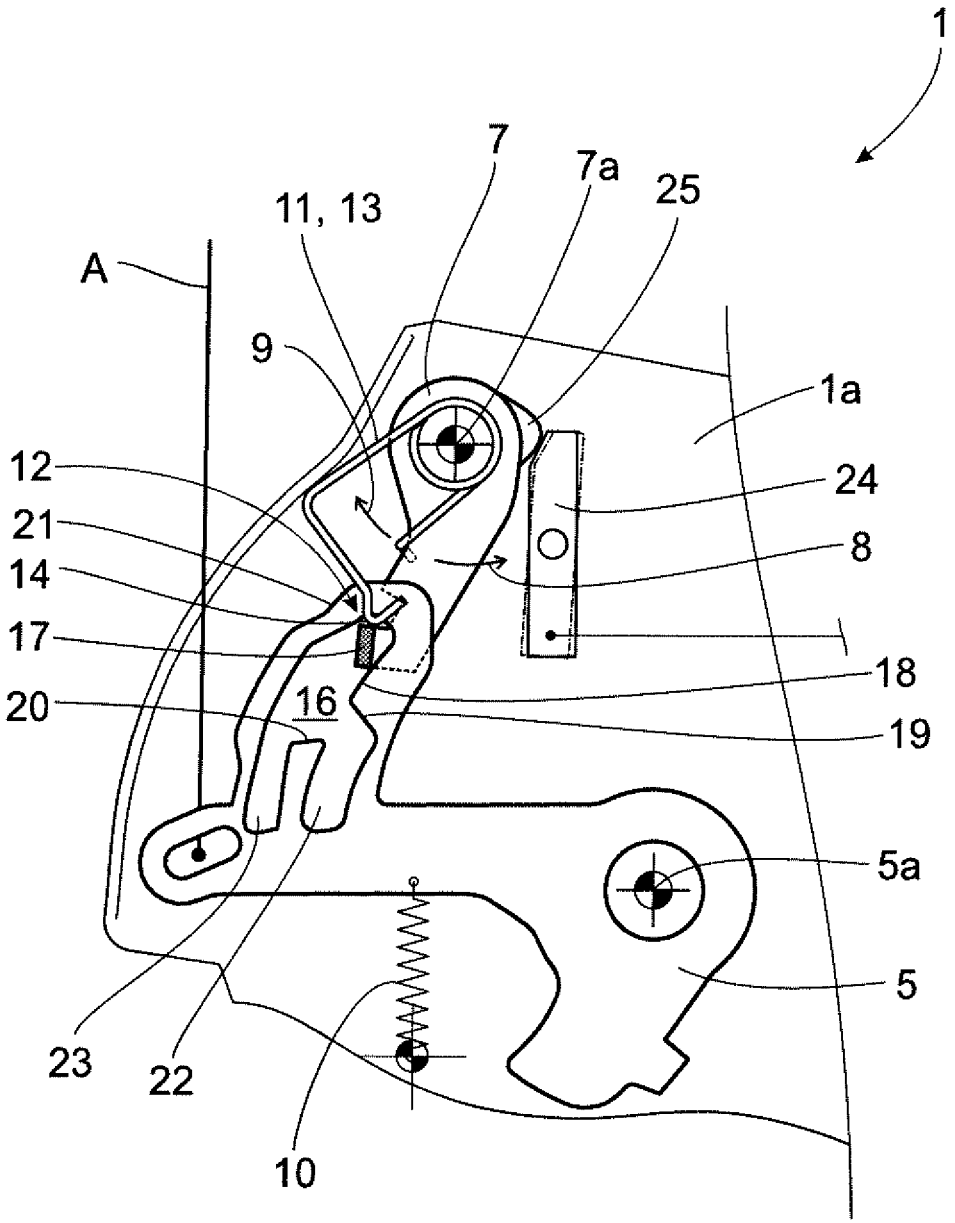
FIG. 5 shows the arrangement according to FIG. 2 in a further embodiment with the actuating lever unactuated.

FIG. 5 shows an alternative embodiment of the proposed motor vehicle lock 1, in which the crash element 7 located in the crash position does not block the actuating lever 5 but is decoupled from the locking pawl 5. This means that an actuation of the actuating lever 5 at an actuating lever speed above the limit speed runs freely. In the event of a crash, the cam follower 17 comes into engagement with the crash-cam portion 20, so that the crash element 7, as explained in connection with the first exemplary embodiment, is adjusted from the central position in the second adjusting direction 9 into the crash position. However, the crash-cam portion 20 here does not provide a blocking surface. Instead the crash-cam portion 20 guides the cam follower 17 into the cam channel 23 so that the actuating lever 5 is able to reach its actuating position. However, this actuation of the actuating lever 5 has no effect on the locking pawl 3, since the actuating lever 5 has been previously decoupled from the locking pawl 3. The exemplary embodiment shown in FIG. 5 namely comprises a coupling lever 24 of a coupling, not shown, which in the actuated state effects an interruption of the drive train B between the actuating lever 5 and the locking pawl 3. In this case, the crash element 7 is provided with a cam lobe 25 which, during the adjustment of the crash element 7 from the central position into the crash position, is brought into engagement with the coupling lever 24 and triggers an actuation of the coupling, which is associated with the above interruption of the drive train B between the actuating lever 5 and the locking pawl 3.

The invention claimed is:

1. A motor vehicle lock comprising:

a latch, a locking pawl, an actuating lever which is pivotable about an actuating lever axis, by the actuation thereof the locking pawl being disengageable from an initial position into an actuating position, and an adjustable crash element which is adjustable into a released position in which the locking pawl is disengageable by an actuation of the actuating lever and into a crash position in which the crash element blocks the actuating lever in a blocked position or decouples the actuating lever from the locking pawl, wherein the crash element is coupled to the actuating lever such that, with an actuation of the actuating lever and depending on the actuating lever speed, the crash element reaches the released position from a central position either in a first adjusting direction or the crash element reaches the crash position in a second adjusting direction and is latched in the crash position, wherein the coupling between the actuating lever and the crash element comprises a control mechanism for the movement control of the crash element, said control mechanism guiding the crash element from the central position, either into the released position or into the crash position depending on the actuating lever speed, the motor vehicle lock further comprising a crash element spring, the crash element spring pretensioning the crash element.

2. The motor vehicle lock as claimed in claim 1, wherein the first adjusting direction of the crash element and the second adjusting direction of the crash element are opposed to one another.

3. The motor vehicle lock as claimed in claim 1, wherein the crash element is pivotable about a crash element axis and wherein the crash element reaches the central position, the released position and the crash position by a pivoting of the crash element about the crash element axis.

4. The motor vehicle lock as claimed in claim 1, wherein, with an actuation of the actuating lever at an actuating lever speed which is below a limit speed, the crash element reaches the released position from the central position and wherein, with an actuation of the actuating lever at an actuating lever speed which is above the limit speed, the crash element reaches the crash position from the central position and is latched in the crash position, and/or wherein when the crash element is latched in the crash position, a return of the actuating lever into the initial position effects the release of the latching and the adjustment of the crash element into the central position.

5. The motor vehicle lock as claimed in claim 1, the crash element spring pretensioning the crash element into the released position.

6. The motor vehicle lock as claimed in claim 5, wherein the crash element spring latches the crash element during its adjustment into the crash position, wherein the adjustment of the crash element into the crash position is caused by inertial forces acting on the crash element.

7. The motor vehicle lock as claimed in claim 6, wherein with an adjustment of the crash element from the crash position into the central position, the latching of the crash element is released by an overlatching of the crash element spring.

8. The motor vehicle lock as claimed in claim 5, wherein the crash element spring is designed as a wire spring.

9. The motor vehicle lock as claimed in claim 1, wherein when the crash element is latched in the crash position and when the actuating lever returns into the initial position, the control mechanism effects the release of the latching and the adjustment of the crash element into the central position.

10. The motor vehicle lock as claimed in claim 1, wherein when the crash element is latched in the crash state and only when the actuating lever is returned by at least 80 percent relative to the movement range between the initial position and the actuating position, the control mechanism causes the release of the latching and the adjustment of the crash element into the central position.

11. The motor vehicle lock as claimed in claim 10, wherein the control mechanism causes the release of the latching and the adjustment of the crash element into the central position only when the actuating lever is fully returned into the initial position.

12. The motor vehicle lock as claimed in claim 1, wherein the control mechanism comprises a control cam and a cam follower operatively connected to the control cam, and which in each case are assigned to one of the actuating lever and the crash element.

13. The motor vehicle lock as claimed in claim 1, wherein the control cam comprises a start-cam portion, the cam follower being supported thereon by the pretensioning of the crash element spring, when the actuating lever is in the initial position, and said start-cam portion determining the central position of the crash element.

14. The motor vehicle lock as claimed in claim 13, wherein a release-cam portion adjoins the start-cam portion, the cam follower sliding along said release-cam portion when the actuating lever is actuated and depending on the actuating speed at an actuating lever speed below the limit speed, and whereby the crash element, driven by the pretensioning of the crash element spring, is guided from the central position into the released position.

15. The motor vehicle lock as claimed in claim 14, wherein when the crash element is in the released position and when the actuating lever is returned from the actuating position into the initial position, the cam follower comes into engagement with the release-cam portion and slides along said portion, whereby the crash element is guided counter to the pretensioning of the crash element spring from the released position into the central position.

16. The motor vehicle lock as claimed in claim 1, wherein the control cam comprises a crash-cam portion and wherein, with an actuation of the actuating lever and depending on the actuating lever speed by the mass inertia of the crash element the cam follower comes into engagement with the crash-cam portion and slides along the crash-cam portion, whereby the crash element is guided from the central position into the crash position counter to the pretensioning of the crash element spring, and is latched there.

17. The motor vehicle lock as claimed in claim 1, wherein the control cam comprises a reset-cam portion and wherein when the crash element is latched in the crash position and when the actuating lever has returned from the blocked position into the initial position, the cam follower comes into engagement with the reset-cam portion and slides along said portion, whereby the crash element is guided from the crash position into the central position, releasing the latching.

18. The motor vehicle lock as claimed in claim 16, wherein the crash element in the crash position blocks a further actuation of the actuating element in the blocked position via the engagement between the cam follower and the crash-cam portion.

* * * * *